US007001158B2

(12) United States Patent
Dunn

(10) Patent No.: US 7,001,158 B2
(45) Date of Patent: Feb. 21, 2006

(54) DIGITAL FLUID PUMP

(75) Inventor: Richard J. Dunn, Florissant, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 271 days.

(21) Appl. No.: 10/351,040

(22) Filed: Jan. 24, 2003

(65) Prior Publication Data

US 2004/0146417 A1 Jul. 29, 2004

(51) Int. Cl.

| | |
|---|---|
| ***F04B 17/04*** | (2006.01) |
| ***F04B 49/00*** | (2006.01) |
| ***F04B 17/00*** | (2006.01) |
| ***F04B 49/06*** | (2006.01) |
| ***F04B 39/10*** | (2006.01) |

(52) U.S. Cl. ..... 417/417; 417/38; 417/44.1; 417/410.1; 417/415; 417/416; 417/555.1; 417/554.1; 417/551

(58) Field of Classification Search ..... 417/417, 417/38, 44.1, 410.1, 415, 416, 555.1, 554, 417/551

See application file for complete search history.

(56) References Cited

U.S. PATENT DOCUMENTS

| | | | | |
|---|---|---|---|---|
| 1,684,468 A | | 9/1928 | Brown | |
| 2,515,110 A | | 7/1950 | Bornstein | |
| 2,690,128 A | | 9/1954 | Basilewsky | |
| 3,282,219 A | | 11/1966 | Blackwell et al. | |
| 3,384,021 A | * | 5/1968 | Perron | 417/417 |
| 3,422,765 A | * | 1/1969 | Schoch | 417/418 |
| 3,542,495 A | * | 11/1970 | Barthalon | 417/416 |
| 3,754,154 A | | 8/1973 | Massie | |
| 3,791,770 A | | 2/1974 | Farkos | |
| 3,884,125 A | | 5/1975 | Massie | |
| 3,894,817 A | * | 7/1975 | Majoros et al. | 417/415 |
| 4,692,673 A | * | 9/1987 | DeLong | 318/132 |
| 5,055,758 A | | 10/1991 | Hock | |
| 5,100,304 A | | 3/1992 | Osada et al. | |
| 5,106,268 A | * | 4/1992 | Kawamura et al. | 417/45 |
| 5,403,168 A | | 4/1995 | Evenson | |
| 5,509,792 A | * | 4/1996 | Sullivan et al. | 417/417 |
| 5,937,829 A | * | 8/1999 | Endou | 123/497 |
| 6,127,750 A | * | 10/2000 | Dadd | 310/13 |
| 6,129,073 A | * | 10/2000 | Yamakado et al. | 123/490 |
| 6,237,617 B1 | | 5/2001 | Sturman et al. | |
| 6,308,690 B1 | * | 10/2001 | Sturman | 123/508 |

OTHER PUBLICATIONS

Delphi Automotive Systems, "Electronic Returnless Fuel System Product Information", 1997, Flint, Michigan.

(Continued)

*Primary Examiner*—Timothy P. Solak
(74) *Attorney, Agent, or Firm*—Blakely, Sokoloff, Taylor & Zafman LLP

(57) ABSTRACT

Digital fluid pumps having first and second electromagnetic actuators formed in part by a piston to alternately drive the piston in opposite directions for pumping purposes. The piston motion is intentionally limited so that the electromagnetic actuators may operate with a high flux density to provide an output pressure higher than that obtained with conventional solenoid actuated pumps. The electromagnetic actuator coils are electrically pulsed for each pumping cycle as required to maintain the desired fluid flow and output pressure, with the piston being magnetically latchable at one or both extreme positions between pulses. Alternate embodiments and control methods and systems are disclosed.

28 Claims, 5 Drawing Sheets

OTHER PUBLICATIONS

Delphi Automotive Systems, "In-Tank Electric Fuel Pumps Medium and High Pressure Turbine Production Information", 1997, Flint, Michigan.

Airtex Products, Master Parts Division, "Domestic and Import Fuel Pumps and Assemblies— Fuel Filters for Fuel Injected-Carbureted Systems Catalog FP97", 1997, pp. 127-139 and 156-157, Fairfield, Illinois.

Artemis Intelligent Power Ltd, "Digital Displacement Pump Product Information", Dec. 8, 2001, Scotland, UK.

ACDELCO, "Fuel Pumps Product Information", Feb. 12 , 2002.

Visteon Corporation, "Innovations: Brushless Fuel Pump" Sep. 11, 2001.

MEDO USA, Inc., "Pump and Air Compressor Features and Applications Production Information", Feb. 25, 2002, Hanover Park, Illinois.

* cited by examiner

DIGITAL FLUID PUMP

BACKGROUND OF THE INVENTION

1. Field of the Invention

The present invention relates to the field of fluid pumps.

2. Prior Art

The present invention is an electrically actuated fluid pump, and in one form, is adapted for use in the automotive market to provide fuel at sufficient pressure and flow rate for use in fuel injected internal combustion engines for vehicles. Accordingly, the prior art relative to this application will be discussed.

At the present time, conventional fuel systems for fuel injected internal combustion engines for vehicles are usually of one of two configurations, namely, fuel systems of the return type or fuel systems of the returnless type. Return type fuel systems are configured in a circulation loop, whereby fuel is pumped from the fuel supply tank through a fuel filter and a fuel rail to a mechanical regulator. Typically, the fuel transfer pump on such systems continuously pumps fuel at a flow rate higher than is needed for combustion in the engine, with the fuel that is not needed passing through a mechanical regulator and being returned to the tank, thereby completing the circulation loop. The fuel transfer pump typically is located in the fuel tank and is an electric pump, such as a gerotor or turbine pump running at maximum speed and electrical current at all times while the engine is running. Because of this, these fuel systems are not very energy efficient, as they typically are not only pumping fuel to the desired pressure for the rail supplying the fuel injectors at a flow rate greater than the engine ever needs for combustion, but at a rate many times what the engine needs at idle and under low load conditions.

Returnless fuel systems use a mechanical pressure regulator located in the fuel tank itself, which is normally supplied by a turbine pump, again running at full output at all times while the engine is running. Thus, bath the return type and returnless type fuel systems have relatively low energy efficiency. Also, the initial performance characteristics of the fuel may be degraded over time due to excessive working, as typical pump outputs are on the order of about 53 gallons per hour (i.e., about 3,333 milliliters per minute). Typical fuel transfer pumps used, have close manufacturing tolerance components making them subject to possible locking up. They are relatively high-speed pumps powered by DC brush type motors that can tend to become noisier over the life of the pump, and may also produce arcing in the fuel tanks, presenting a fire hazard. The constant pumping may degrade the fuel, or at least change the fuel characteristics from the initial values.

Solenoid actuated fuel transfer pumps are also well known in the prior art. A typical fuel transfer pump of this type is in the form of a reciprocal piston (or diaphragm) pump with an analog type solenoid actuator being used to move and maintain (with continuous electrical current) the piston in one direction against a mechanical return spring biasing the piston in the opposite direction. Typically, electrical actuation of the solenoid moves the piston in a fill direction to cause fuel to backfill the piston chamber. When the solenoid is de-energized, the mechanical return spring then provides the fluid pumping force. Consequently, the outlet fluid pressure of such pumps is determined by the force of the mechanical return spring, not the solenoid, so that the output fluid pressure will be independent of the voltage applied to the solenoid for operation thereof.

A solenoid operated fluid pump of the foregoing type is disclosed in U.S. Pat. No. 5,100,304 issued to Osada et al. on Mar. 31, 1992. In the pump shown therein, electromagnets formed by magnetic poles and magnetic coils attract an armature to compress a spring and backfill the pumping piston, with the spring providing the pumping force when the electromagnet is turned off. If a permanent magnet armature is used, as disclosed in U.S. Pat. No. 4,692,673 issued to Delong on Sep. 8, 1987, or two solenoid coils are used so as to be able to attract the armature m either direction, as disclosed in U.S. Pat. No. 3,282,219 issued to Blackwell et al. on Nov. 1, 1966, the spring may be eliminated in favor of solenoid actuation for both directions of motion of the armature. However, pumps of this type typically provide a relatively low output fluid pressure, perhaps suitable for only relatively low pressure delivery of fuel from a fuel tank to an ordinary carburetor on a vehicular engine, or perhaps from a fuel supply tank to a high pressure fluid pump on a diesel powered system, but do not have the capability of providing fuel at the required system pressure for fuel injected vehicles. By way of example, in the '304 patent mentioned above, electromagnets on associated radially oriented poles cause the armature to be attracted axially into alignment with the electromagnets. However, the magnetic field provides only a relatively weak axial force on the armature. Consequently, magnetic circuits of this type may be used to provide a substantial pumping stroke, but not with any substantial fluid pumping force or pressure.

In U.S. Pat. No. 3,282,219 (Blackwell et al.), two solenoid coils are placed substantially end to end so that each one, when excited, will cause an armature doing the pumping to move axially to attempt to center itself longitudinally with respect to that solenoid coil. When the solenoid coil is powered with one end of the armature only partially within the solenoid coil, the solenoid coil provides a magnetic field resulting in a force on the armature substantially perpendicular to that end of the armature, with the field lines wrapping around the solenoid coil and primarily re-entering the armature radially in the part of the armature still protruding out of one end of the solenoid coil. Thus, the longitudinal force on the armature under this condition is proportional to the square of the flux density across the area of the end of the armature within the coil, times the cross sectional area of the armature. However, note that there is a very large nonmagnetic gap in the magnetic circuit, so that the flux densities achievable may be too low to obtain any substantial fluid pumping pressure. U.S. Pat. No. 4,692,673 (DeLong), utilizing a permanent magnetic armature in a multiple coil system, is similar in that regard. In essence, pumps of the '219 (Blackwell et al.) and '673 (DeLong) patents potentially have an even greater stroke than that of the '304 patent, but achieve the large stroke only with a relatively low fluid pumping pressure.

U.S. Pat. No. 5,106,268 issued to Kawamusa et al. on Apr. 21, 1992 discloses an outlet pressure control system for electromagnetic reciprocating pumps that includes the capability of controlling both the frequency of reciprocation and the length of the stroke, The piston of the pump has an armature at each end thereof, each with an associated electromagnetic drive means. The piston and armature are biased toward a center position by springs at each end of the assembly. Half wave rectified electrical power is applied to one of the electromagnetic drive means, with the alternate half wave electrical power being applied to the other electromagnetic drive means, so that one of the electromagnetic drive means is electrically powered at all times. The frequency of the half wave rectified power determines the frequency of reciprocation of the pump, with the voltage of the half wave rectified power determining the pump stroke. The control of one or both parameters is responsive to a pressure sensor in the pressure tank being pressurized by the pump. Because one of the actuator coils is electrically powered at all times, independent of pressure and flow rate, the pump may not be very energy efficient Also, the type of actuator disclosed is of the relatively long stroke, low force type, the long stroke better accommodating control of the stroke, though the low force of the actuators very much limiting the fluid pressure output attainable.

BRIEF SUMMARY OF THE INVENTION

Digital fluid pumps having first and second electromagnetic actuators formed in part by a piston to alternately drive the piston in opposite directions for pumping purposes are disclosed. The piston motion is intentionally limited so that the electromagnetic actuators may operate with a high flux density to provide an output pressure higher than that obtained with conventional solenoid actuated pumps. The electromagnetic actuator coils are electrically pulsed for each pumping cycle as required to maintain the desired fluid flow and output pressure, with the piston being magnetically latchable (without electrical current) at one or each extreme position between pulses. Alternative embodiments of the pumps and alternative control systems and methods are disclosed.

DETAILED DESCRIPTION OF THE PREFERRED EMBODIMENTS

Disclosed herein are digital electromagnetically actuated fluid pumps and methods and apparatus for operating the fluid pumps which are energy efficient and which provide accurate control of the fluid pressure obtained, which maximum attainable fluid pressure may be much higher than that obtained with prior art solenoid actuated fluid pumps. Embodiments of the present invention may be used, for example, as fuel transfer pumps for internal combustion engines of vehicles and provide an adequate output fluid pressure to pressurize a rail supplying fuel under pressure to a fuel injection system of the engine. The fluid pumps themselves are dual actuator double-acting pumps with one actuator doing the fluid pumping and the other actuator causing the backfilling of the piston with fluid in readiness for the next pumping stroke.

More specifically, the actuators are what may be referred to as direct electromagnetic attraction actuators. In these actuators, the piston functions both as an armature and as a piston and has an end face against which an axial magnetic field may act, and in addition, the stationary part of the magnetic circuit has an adjacent parallel magnetic pole face, thereby resulting in a relatively uniform magnetic field across the effective area of the end of the armature. The magnetic circuits of the two actuators are generally configured so as to have no other substantial non-magnetic gap therein. Accordingly, by using a relatively short stroke armature, relatively high flux densities may be provided in the gap between the armature end and the end cap of the fixed housing. In that regard, preferably the flux density in the air gap approaches or reaches the saturation flux density at the surface of the adjacent magnetic members, such as preferably at least 70% of the saturation flux density of the magnetic members, and more preferably at least approximately 90% of the saturation flux density of the associated magnetic members.

In addition, since upon electrical actuation, each actuator will electromagnetically pull the piston or armature directly against the stationary magnetic member, there will then be substantially no air gap in the magnetic circuit. Accordingly, the residual magnetism of the magnetic member can be selected to result in the piston being magnetically latched in an actuated position until the opposite actuator is electrically powered, at least for the return stroke of the piston. While an alternative feature to the invention, this may have the advantage of keeping the piston in a desired position even after electrical power is removed. These and other aspects of the present invention will become apparent from the description to follow.

Figure 1:
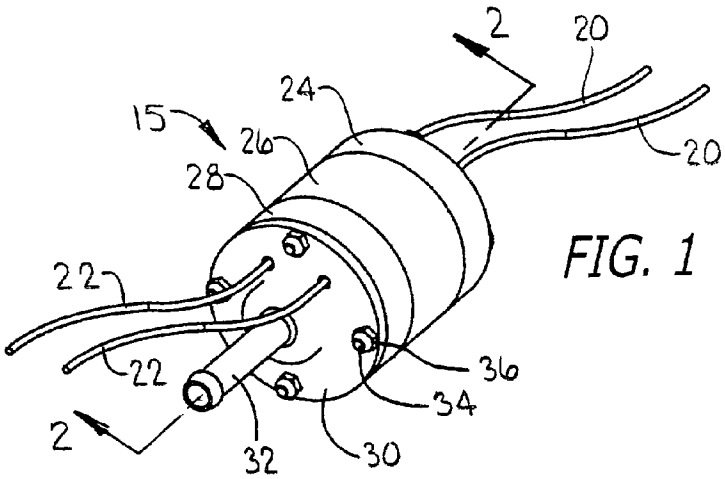
FIG. 1 is a perspective view of the fluid pump of one embodiment of the present invention.

Now referring to FIG. 1, a perspective view of the fluid pump 15 of a preferred embodiment of the present invention may be seen. As viewed in this Figure, the fluid pump 15 comprises an assembly including four electrical leads, two leads 20 being for one or a first actuator coil and the other two leads 22 for another or second actuator coil. The fluid pump 15 further includes a first end cap 24, a pump body 26 and a second end cap 28, all formed from magnetically attractable material. (A "magnetic material" may include more than a single magnetic material such as, for example, a steel alloy.) The fluid pump 15 also includes a final outlet-defining cap 30 with a fluid pump outlet such as tube 32 or port located thereon. The first end cap 24, the pump body 26, the second end cap 28 and the outlet defining cap 30 are all fastened together in coaxial alignment by, for example, threaded tie rods 34 and nuts 36.

Figure 2:
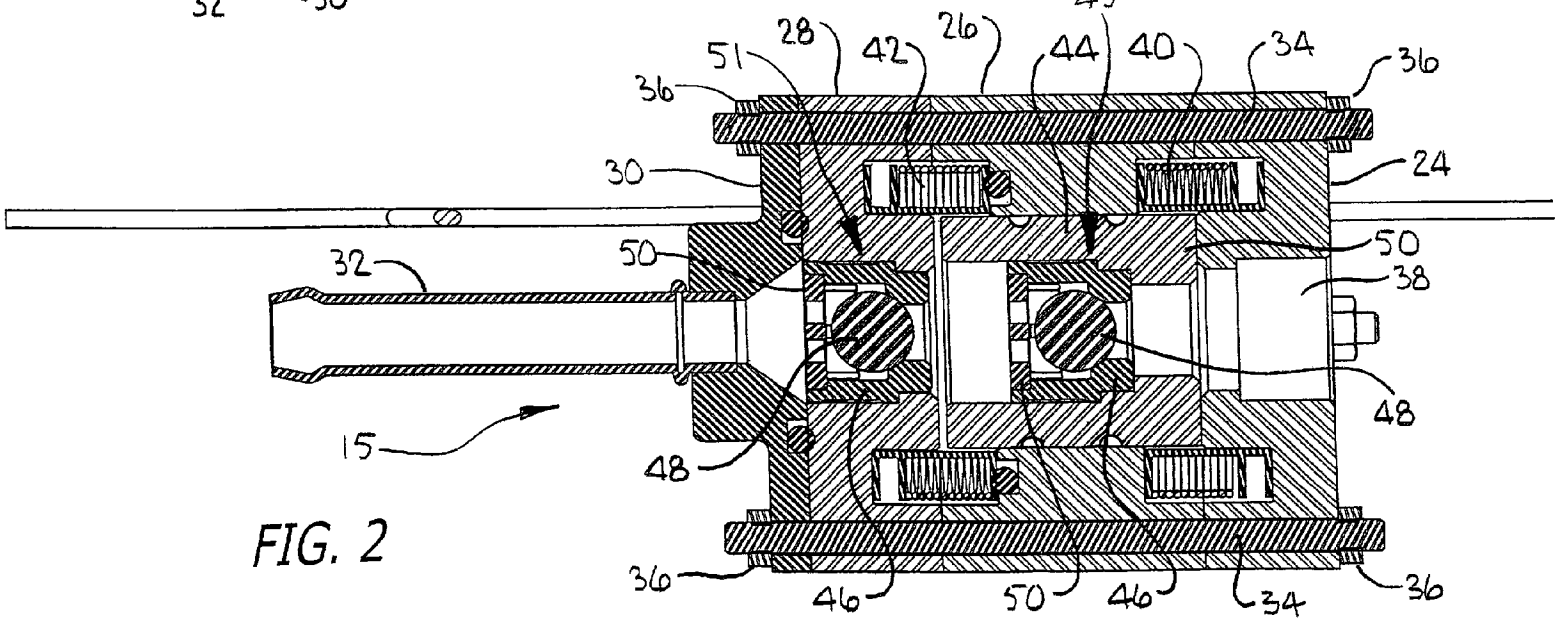
FIG. 2 is an enlarged cross-sectional view of the fluid pump of FIG. 1 taken along line 2—2 of FIG. 1.

Now referring to FIG. 2, an enlarged cross-section of the fluid pump of FIG. 1 may be seen. The first end cap 24 has a fluid supply inlet 38. In that regard, the embodiment being described is intended to be immersed in fluid (e.g. fuel or other fluid) within a fluid supply tank, though of course an inlet tube or other arrangement may be provided if this is not the case, or for other possible applications of the fluid pump. Between the pump body 26 and the first end cap 24 is a first actuator coil 40, and between the pump body 26 and the second end cap 28 is a second actuator coil 42. Also fitting within pump body 26 is a movable piston 44 that also is formed from magnetically attractable material. The piston 44 is reciprocally movable along an axis of the pump body 26. The piston 44 has a reasonably close sliding fit within the pump body 26, having a diametrical clearance with respect to the pump body on the order of about 0.02 to 0.04 millimeters (about 0.0008 to 0.0016 inches).

Figure 3:
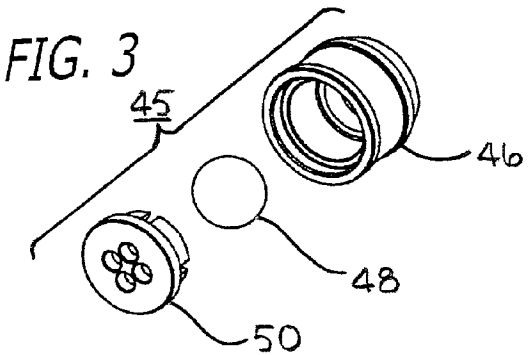
FIG. 3 is a perspective exploded view of an exemplary ball valve used in the embodiment of FIGS. 1 and 2.

Within the reciprocable piston 44 itself is one of a first one-way ball valve 45, shown in cross-section in FIG. 2 and in an exploded perspective view in FIG. 3. The ball valve 45 is comprised of three members, specifically, ball valve seat 46, ball 48 and ball valve retainer 50. The ball valve retainer 50 allows fluid to flow only one way there through while retaining the ball 48 adjacent to the ball valve seat 46. Thus, fluid may flow in only one direction through the ball valve seat 46, past the ball 48 and out the ball valve retainer 50. However, the ball 48 will seal against the ball valve seat 46 to prevent fluid flow in the opposite direction. Another or a second similar one-way ball valve 51 is positioned in the second end cap 28. Thus, when the piston 44 moves to the left or towards its pumping direction, the ball 48 in the piston 44 closes and the piston 44 forces semi-trapped fluid through the ball 48 in the second end cap 28. When the piston 44 moves to the right or towards its backfilling position as shown in FIG. 2, the ball 48 in the second end cap 28 closes and the ball 48 within the piston 44 opens to allow a new charge of fluid to backfill the volume swept out by the piston 44 in readiness for the next fluid pumping stroke. Alternatively, the second ball valve 51 may instead be similarly positioned in first end cap 24.

With no electrical power applied to either actuator coil 40,42 and with the piston 44 in the rightmost position shown in FIG. 2, the piston 44 will be magnetically latched or retained in that position by the forces of residual magnetism in the magnetic circuit comprising the first end cap 24, the pump body 26 and the piston 44. Optionally, the tie rods 34 may also be fabricated of a magnetic material and, therefore, may form part of the magnetic circuit. In this right-most position, it will be noted that the air gap in this magnetic circuit is substantially zero, the end face of piston 44 being held against the face of the first end cap 24. While there may be some clearance between the piston 44 and the pump body 26 providing a non-magnetic gap in the magnetic circuit, that gap is relatively small. Its effect is further diminished by the fact that the effective area of that gap is considerably larger than the end of the piston 44 abutting the first end cap 24. Therefore, the demagnetizing effect of any non-magnetic gap between the piston 44 and pump housing 26 is reduced. Other than the magnetic latching force due to the residual magnetic force of the magnetic parts, there are no other substantial forces acting on the piston 44 in this position. Because the pressure of the fluid in the outlet tube 32 is retained by the ball 48 in the second end cap 28, the fluid pressure on each side of the ball 48 in the piston 44 is substantially the same. Consequently, the magnetic materials should be selected to provide adequate residual magnetic force to retain piston 44 in this position. In an exemplary embodiment, piston 44, pump housing 26, first end cap 24 and second end cap 28 are fabricated from 1018 alloy steel.

A pumping stroke is initiated by applying electrical power to coil 42, preferably with a magnetizing sense opposite to that of coil 40 when the coil 40 is electrically powered. This creates a relatively high flux density in the gap between the left end of piston 44 and the face of the second end cap 28, the magnetic flux passing through the magnetic circuit comprising piston 44, second end cap 28 and pump body 26. Generally speaking, the flux density holding piston 44 in the right-most or full backfill position (per FIG. 2) due to the residual magnetic force of the first end cap 24, etc., will be only a fraction of the saturation density of the material, and since that holding force is proportional to the square of the flux density, the holding force will be only a fraction of the magnetic attractive force pulling piston 44 to the left-most position due to the actuator current in coil 42. Thus, on electrically powering coil 42, piston 44 will be electromagnetically attracted and moved to the left-most or full pump stroke position, displacing some of the fluid between the two ball valves past the ball 48 in the second end cap 28 to the delivery tube 32. Once piston 44 has reached its left-most position at the end of the pumping stroke, electrical power to coil 42 may be terminated and electrical power applied to coil 40 at any time thereafter to electromagnetically attract and move (i.e., return) the piston 44 to the position shown in FIG. 2 in readiness for the next fluid pumping stroke.

When electrical power is first applied to coil 42 and piston 44 begins to move, any residual magnetic field between piston 44 and end cap 24 will collapse, so that the only significant force acting against the magnetic force for the fluid pumping stroke is the pressure of the fluid in the outlet tube 32, viscous effects and the force required to accelerate the mass of the piston 44, the ball 48 within the piston 44, and the fluid moving therewith. Thus, at low fluid outlet pressures, the fluid pumping stroke may be actuated with a relatively short electrical pulse, such as something on the order of about one millisecond. As the desired outlet fluid pressures increase, longer electrical pulses are required. However, when the fluid pressure forces acting on the cross-sectional area of the piston equal the magnetic forces generated by coil 42 on the end of the piston 44, there will be no further fluid pumping, independent of how long coil 42 may have electrical power applied to it.

To be sure, when first applying electrical power to coil 42, that an adequate flux density is obtained between piston 44 and second end cap 28, it is important that the initial gap between piston 44 and end cap 28 not be excessive, and an adequate electrical current is provided through coil 42 to provide the required magnetizing force (ampere turns) to obtain the degree of magnetic saturation desired. In that regard, note that the left end of piston 44 has an area slightly less than the right end of second end cap 28 against which it will abut. Accordingly, when saturation is referred to herein, as applied to the fluid pumping stroke, reference is being made to the pole face at the left end of piston 44 (the smaller of the two pole faces, though both pole faces may be the same size if desired). It is preferable that the smaller pole face area, or both pole face areas if they are the same size, essentially be the smallest cross-sectional area in the magnetic circuit linking coil 42, so that saturation elsewhere in the circuit does not first occur to limit the flux density achievable in the initial gap between piston 44 and second end cap 28.

The foregoing would suggest that the fluid pumping stroke be as short as possible. On the other hand, check valves, whether of the ball valve design in the embodiment hereinbefore disclosed or of some other design, typically exhibit some lost fluid pumping motion per actuation of the check valve. Such lost motion is a fixed quantity independent of the piston stroke. Further, shorter strokes may require too high an operating frequency to obtain reasonable fluid flow rates. In one embodiment of the present invention, a stroke of about 0.75 millimeters (about 0.03 inches) was used. A substantially linear change in fluid flow with pumping frequency was obtained up to an operating frequency of almost 40 hertz. The 0.75 millimeter (0.03 inch) gap in theory would require about 1000 ampere turns for coil 42 to provide a flux density in the gap of about 20,000 Gauss.

Depending on the magnetic material used, an even somewhat higher number of ampere turns would be preferable. One thousand ampere turns might represent, by way of example, a 10 amp pulse through a 100 turn coil. The 10 amps, of course, would not necessarily represent the steady electrical current drawn by the fluid pump 15, particularly at a lower fluid flow rate, as the duty cycle of the coils 40,42 is approximately proportional to fluid flow rate, so that at lower fluid flow rates, the average electrical current required by the fluid pump 15 is also lower.

At any given frequency, the fluid pumping rate, of course, could be increased by increasing the stroke. If, however, the stroke were doubled, twice the ampere turns would be required to achieve the same flux density in the gap. This would result in about four times the $I^2R$ losses in coil 42, and require a longer duration electrical actuation pulse for the piston 44 to move through the longer stroke. While a greater flow rate per stroke would be achieved, the maximum duty cycle would likely have to be substantially reduced to prevent overheating of the coil, more than making up for the increase flow per stroke.

For the return stroke, coil 40 is electrically pulsed to move the piston 44 back to the right-most or full backfill position shown in FIG. 2. Since this motion merely backfills with supply fluid the volume swept by the piston 44, the electromagnetic force needed to move the piston 44 to the right-most or full backfill position may be relatively low. Accordingly, the electrical pulse in coil 40 does not necessarily have to bring the respective magnetic circuit to saturation, or close to saturation, though faster actuation will occur if it does. Further, because the movement of the piston 44 to the right-most or full backfill position shown in FIG. 2 is independent of the outlet fluid pressure in delivery tube 32, an electrical pulse of fixed time duration may be used to pulse coil 40, independent of the fluid delivery pressure. While a smoother (i.e., more easily filtered for electrical noise reduction) demand of electrical power would occur, particularly at lower fluid flow rates, if the electrical pulsing of coil 42 and coil 40 was evenly staggered, it is preferred, particularly when pumping to higher desired fluid pressures, that the electrical pulse to coil 42 for the fluid pumping stroke be immediately followed by electrical pulsing of coil 40 for the return stroke. In particular, when coil 42 is electrically powered so that the piston 44 moves to the left-most or full pump stroke position, at that point the outlet fluid pressure is acting directly against the ball 48 in the piston 44 itself. The resulting fluid pressure force on the effective area of the piston 44 will likely exceed the holding or magnetically latching force from the residual magnetic force of the magnetic circuit associated with coil 42. A slower than necessary return stroke of the piston 44 could increase backflow of fluid through the ball 48 in the second end cap 28. Consequently, while staggered operation of the coils 40 and 42, particularly at lower fluid flow rates, is contemplated by the invention, electrical pulsing of coil 40 immediately after electrical pulsing of coil 42 is complete is preferred.

Figure 4:
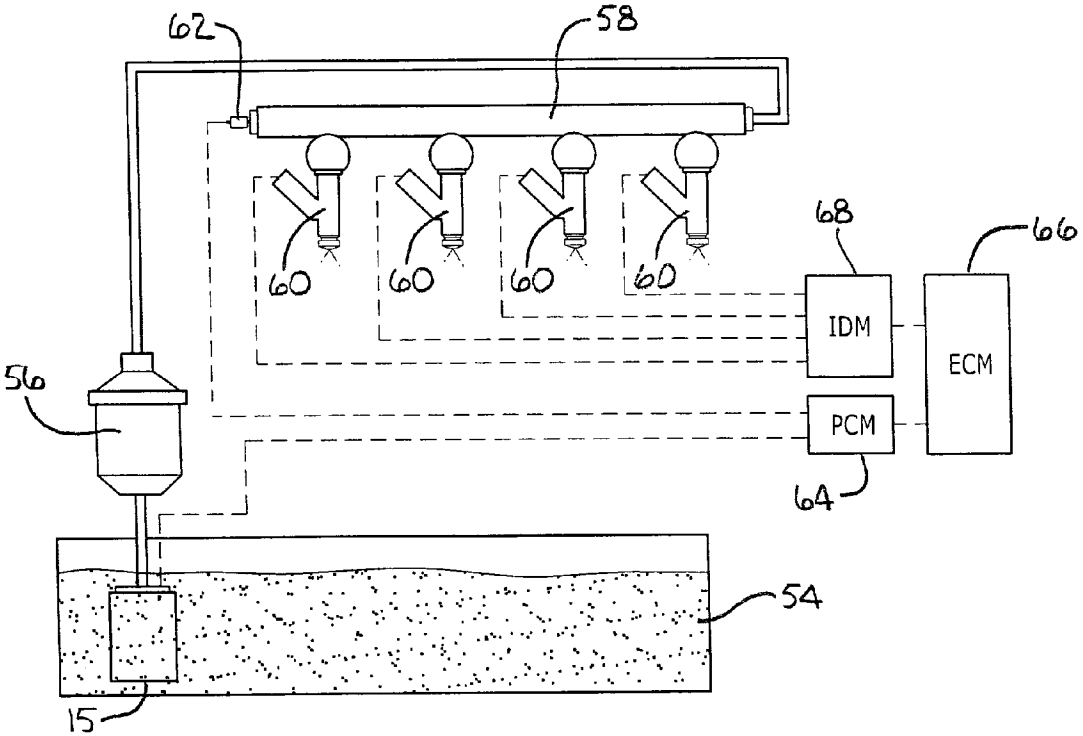
FIG. 4 is a schematic diagram of a fluid injection system for a four-cylinder engine utilizing the present invention.

Now referring to FIG. 4, a schematic diagram of a fuel or other fluid injection system for a four-cylinder internal combustion engine utilizing the present invention may be seen. As shown therein, a fluid transfer pump 15, such as shown in FIGS. 1 through 3, may be placed in a fuel supply tank 54 so as to draw fuel from the bottom portion thereof. The fluid pump 15 pumps fuel through fuel filter 56 to fuel rail 58 supplying fuel injectors 60 on the engine. Pressure in fuel rail 58 is maintained by a pressure sensor 62 on the rail providing a pressure signal to a pressure control module (PCM) or controller 64. The pressure control module 64 is controlled by an engine control module (ECM) 66 that also controls the injector drive module (IDM) 68 connected to the injectors 60. The pressure control module 64, responsive to the pressure sensor 62, provides the coil drives for coils 40 and 42 (FIG. 2) in the fluid pump 15.

Figure 5:
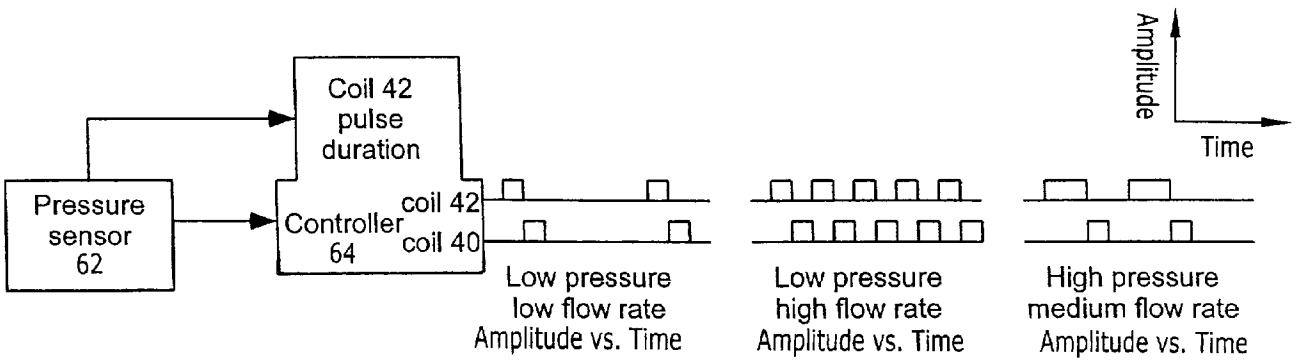
FIG. 5 is a block diagram illustrating one embodiment of fluid transfer pump control in accordance with the fluid injection system of FIG. 4.

One basic form of control in accordance with FIG. 4 is illustrated in FIG. 5. The pressure control module 64 of FIG. 4 is shown in FIG. 5 as the controller providing the excitation pulses for coils 40 and 42. The pressure sensor 62 in this embodiment provides a signal to the controller 64 that compares the signal from the pressure sensor 62 with a pre-determined reference to provide the electrical actuation pulses to coils 42 and 40 at the rate required to maintain the desired fuel pressure in the rail 58 (FIG. 4). The pressure sensor 62 in this embodiment also provides a signal to a part of the controller that determines the pulse duration for coil 42. Thus, as shown in FIG. 5, for a low output fuel pressure and low fuel flow rate, the electrical pulses to coils 40 and 42 may be of substantially the same duration, and occurring only as frequently as required to maintain the desired low fuel pressure at the desired low fuel flow rate. At low fuel pressures but higher fuel flow rates, the frequency of the electrical pulses increases, though the electrical pulse durations need not change. However, as the outlet fuel pressure goes up, the time width or duration of the electrical pulse applied to coil 42 must increase, as the time required to complete the fuel pumping stroke against the higher fuel outlet pressures substantially increases. The return stroke by electrically pulsing coil 42 is independent of fuel pressure, and accordingly need not be varied with the output of the pressure sensor 62. In both cases however, the electrical pulse durations need to be sufficient under any conditions for proper operation of the fluid pump 15 at higher fuel viscosities such as will be encountered at lower fuel temperatures. In one embodiment, the coil 42 pulse duration determining block includes a predetermined look-up table increasing the electrical pulse duration for increasing temperature and/or pressures. Other techniques could be used to determine either or both electrical pulse durations, such as, by way of example, actually sensing arrival of the piston 44 at a commanded position by use of a sensor for that purpose, or monitoring the back EMF in the opposite coil (i.e., sense a voltage change) indicative of the stopping of the piston 44 at the commanded position.

Figure 6:
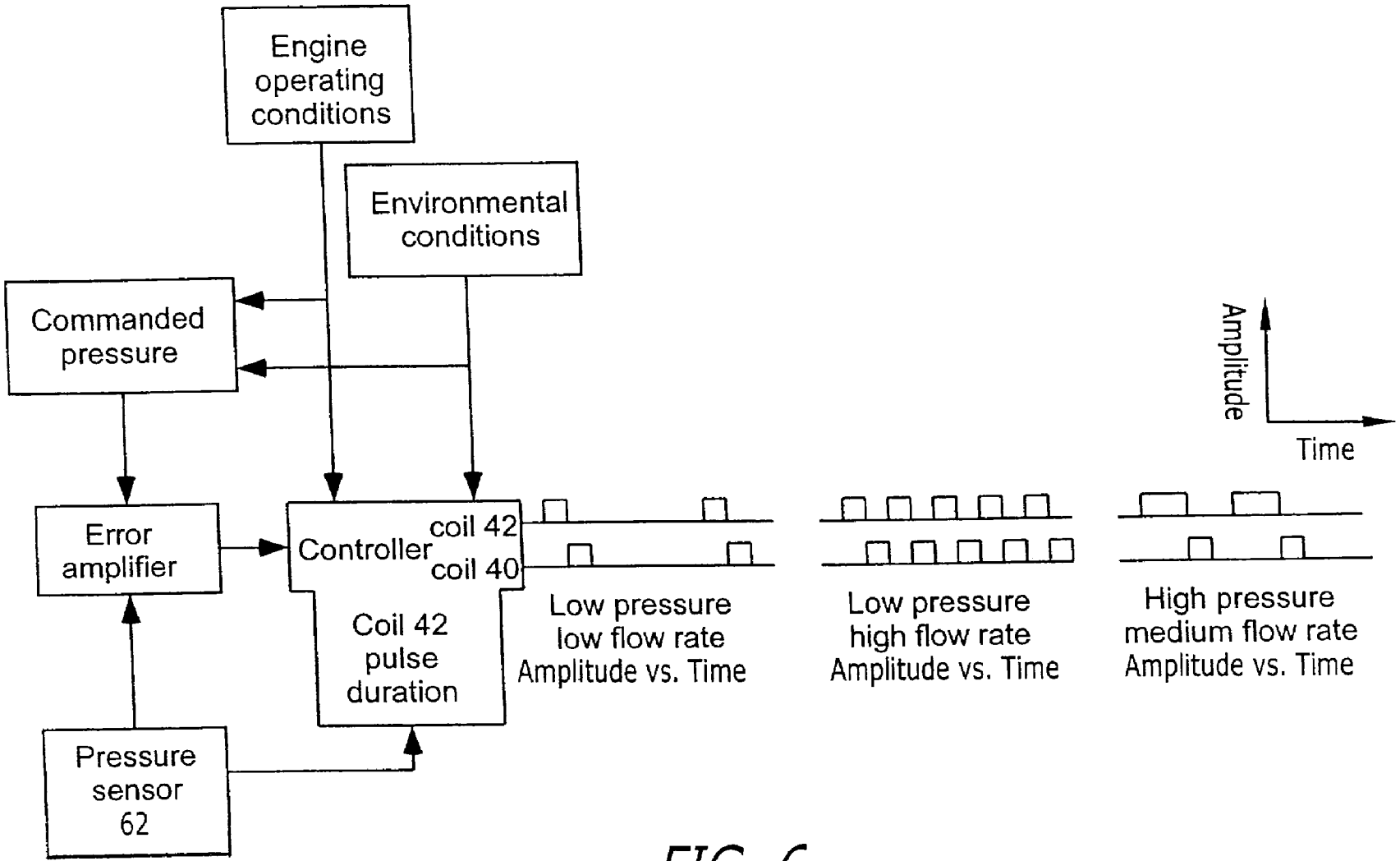
FIG. 6 is a block diagram illustrating an alternative embodiment of fluid transfer pump control in accordance with the fluid injection system of FIG. 4.

FIG. 6 is a block diagram of a more sophisticated control system for controlling the actuator coils 40 and 42 (FIG. 2) in the fluid pump 15 of the present invention. In comparison to the system of FIG. 5, the system of FIG. 6 has two additional capabilities, either of which may be used alone or both of which may be used together as shown in FIG. 6. In particular, the controller, which may be integrated with the engine control module 66 of FIG. 4, is responsive to inputs regarding the engine operating conditions such as may include one or more of engine temperature, engine speed and throttle settings, as well as environmental conditions, which may include one or more of air temperature, air pressure and air moisture content, as well as conditions responsive to environmental conditions, such as fuel temperature. Based on these inputs, the controller can determine what the approximate fluid pumping rate should be under these conditions. Also, the system shown in FIG. 6 has the ability to vary the fluid pressure in the rail 58 with engine operating conditions and environmental conditions to improve efficiency, reduce emissions or for other purposes, by determining a new commanded pressure based on changes in these conditions. The commanded pressure is compared with the output of the pressure sensor 62 to provide an error signal to the controller to adjust the coil drive repetition rate for more accurate control of the fluid transfer pump 15. If desired, the output of the pressure sensor 62 may also be coupled through a coil 42 pulse duration determining block in the controller to provide the coil 42 pulse duration control directly to the controller.

The advantages of the system of FIG. 6 include the ability to vary the fluid pressure in the fuel rail 58 with engine operating conditions and environmental conditions and to provide a faster response by the controller to a change in those conditions. In particular, one might want a lower rail pressure when an engine is idling in comparison to the rail pressure desired when the vehicle is operating at ordinary speeds. Secondly, the system of FIG. 6 responds quickly to a change in an operating condition, such as a driver taking his foot off the accelerator, or alternatively, suddenly pressing the accelerator to the floor to pass by another vehicle. Even if rail pressure is to be maintained constant under these changes in conditions (i.e., the commanded pressure of FIG. 6 is a constant), the controller directly sensing the change in engine operating conditions allows the controller to immediately decrease or increase the fluid pumping rate, as the case may be, based on pre-determined variables rather than waiting for the pressure sensor 62 to start indicating an excessive pressure or a lower than desired pressure before the system responds, as in FIG. 5. Of course, in the system of FIG. 6, the new predetermined fluid pumping rate will typically only be approximate, with the comparison of the commanded pressure and the output of the pressure sensor 62 being provided to the controller as an error signal to correct for any errors in the predetermined new fluid pumping rate. Thus, the system of FIG. 6 provides a faster response to changing conditions even if rail pressure is to be maintained constant, and further provides the ability to vary rail pressure with engine operating conditions and environmental conditions if desired.

Figure 7:
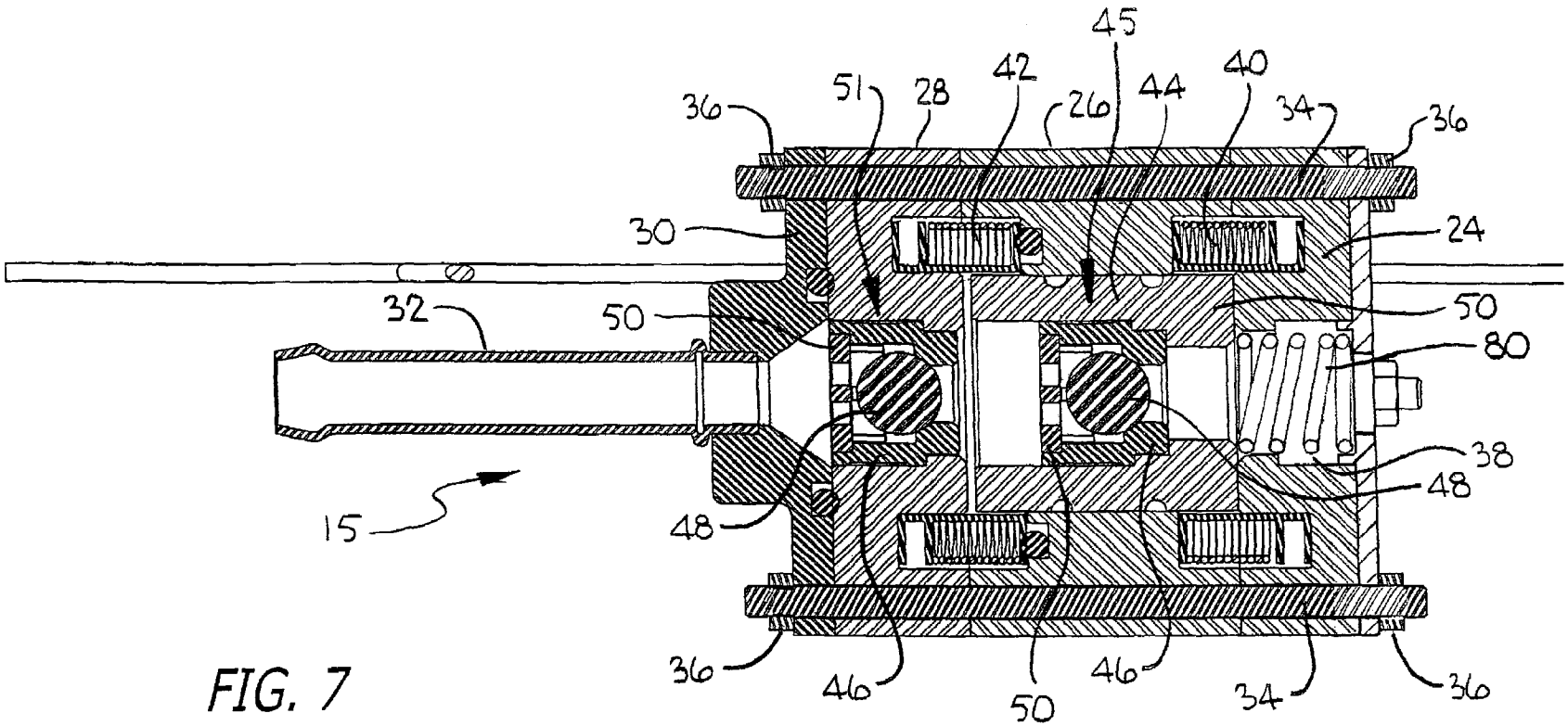
FIG. 7 is a cross-sectional view similar to FIG. 2 but showing an alternative embodiment of the fluid pump of the present invention.

Having now described one embodiment of the fluid pump 15 of the present invention, specifically a fluid transfer pump suitable for use as a fuel transfer pump in fuel injected engines, as well as various control systems therefor, various further alternative embodiments will become apparent to those skilled in the art. By way of example, as shown in FIG. 7 one could provide a preloaded mechanical spring 80 in the inlet region 38 of the fluid pump 15 acting between the first end cap 24 and the end of the piston 44 to bias the piston to the left (the position corresponding to the end of the pumping stroke). The spring 80 might be preloaded; by way of example, to exert a spring force equal to approximately 50% to 75% of the piston return force generated by electrical excitation of coil 40. Now the piston 44 would probably not magnetically latch in the return position by the residual magnetic force of the magnetic parts, but for higher fluid outlet pressures, would remain near the latched position by the capture of a new charge of fuel between the two ball valve, both of which are now closed. In this way, the maximum pumping force and thus the pump outlet pressure is increased above the magnetic force attainable in one actuator alone. For instance, an exemplary embodiment of the present invention is able to attain outlet pressures of about 690 kPa (about 100 psi). The inclusion of such mechanical spring would allow the increase of the outlet fluid pressures to about 1020 to 1190 kPa (about 150 to 175 psi). While for low output pressures, the mechanical spring 80 might in fact complete the pumping stroke after the electrical excitation is removed from coil 40, this would have no effect on the ability to control the fluid outlet pressure as described.

In particular, each pumping sequence (FIGS. 5 and 6) in the preferred sequence provides for electrical excitation of coil 42 immediately followed by electrical excitation of coil 40. Since the duration of electrical excitation of coil 42 is dependent on fluid outlet pressure, that duration could be reduced to zero as the fluid outlet pressure and fluid flow rate drop below the pumping force and rate capable of being provided by the mechanical spring 80 alone, allowing only coil 40 to be electrically pulsed as required to provide the pumping flow rate desired at that low fluid pressure. Thus, the control is substantially the same at all fluid outlet pressures, though the maximum pressure attainable has been substantially increased. At low fluid outlet pressures and fluid flow rates, below the pressure and rate the spring 80 alone will create, operation of the fluid pump 15 could then incorporate certain features of prior art fuel pumps using a mechanical spring to create the fluid pumping force and a return actuator to backfill with fluid the swept volume of the piston.

As a further alternative embodiment of the present invention, the mechanical spring force might be reduced to approximate some percentage of the holding or magnetically latching force due to the residual magnetic force in a magnetic circuit returning the piston 44 to the right-most or full backfill position shown in FIG. 2, thus providing perhaps a 20% increase in the maximum fluid outlet pressure attainable.

As a still further alternative embodiment of the present invention, whether or not a mechanical spring is being used to attain a fluid pressure above the pressure attainable by the pumping actuator 42 alone, the spring force might be chosen to create a pressure of approximately one half the rail pressure desired. Now the minimum magnetic force required for the pumping stroke is equal to the spring force (total pumping force required=twice the spring force), and thus equal to the minimum magnetic force required for the return stroke. This means that the duration of the electrical power pulses for the two strokes can be equal, as the magnetic forces of each actuator that exceed the minimum forces required for either stroke are equal. This should maximize the fluid flow rate attainable for a fluid pump 15 of a given size.

Figure 8:
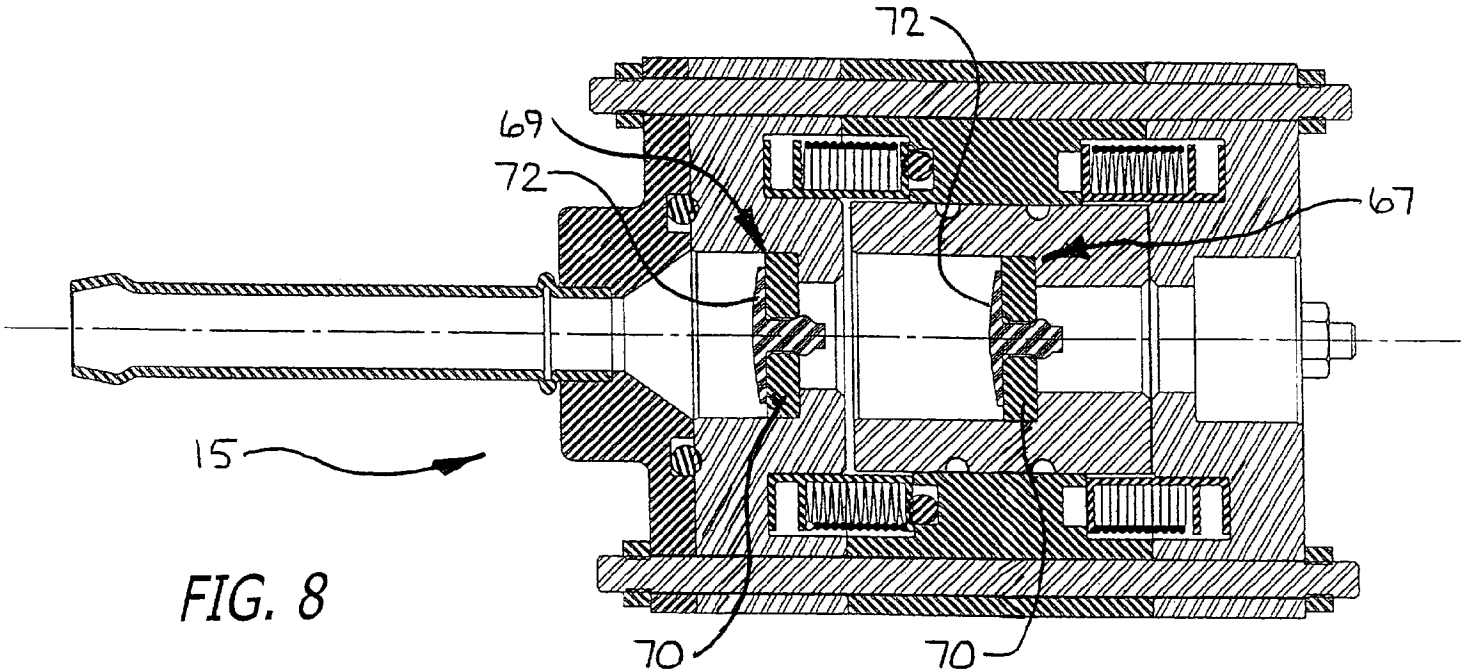
FIG. 8 is a cross-sectional view similar to FIGS. 2 and 7 but showing a further alternative embodiment of the fluid pump of the present invention.
Figure 9:
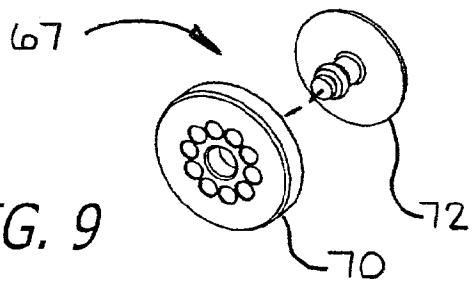
FIG. 9 is a perspective exploded view similar to FIG. 3 but showing an exemplary umbrella check valve used in the alternative embodiment of FIG. 8.

A still further alternate embodiment of the present invention is illustrated in FIGS. 8 and 9. FIG. 8 shows a cross section of a fluid pump 15' similar to the fluid pump 15 of FIG. 2, though using umbrella elastomeric membrane valves 67,69 in place of the ball valves 45,51 of FIG. 2. FIG. 9 is an exploded perspective view showing the details of the umbrella valves 67,69. The umbrella valves are each comprised of a valve seat member 70 and a flexible umbrella valve member 72. Such check or one-way valves are relatively inexpensive to fabricate and work well in many applications, though may or may not have sufficient life, reliability or chemical resistance required for some applications.

While the subject digital fluid pump has been described as a fluid pressure control device, it may also be used as a fluid flow control device, flow being a function of the displacement of the piston 44, frequency of operation and the duty cycle of the pump control module (PCM) 64. Also, while various embodiments of the present invention have been disclosed herein, it will be apparent to those skilled in the art that various changes in form and detail may be made therein without departing from the spirit and scope of the invention.

What is claimed is:

1. A fluid pumping system comprising:

a dual electromagnetic coil, magnetically latchable fluid pump having a piston operative to move between first and second positions, respectively, in response to actuating current pulses in opposed first and second electromagnetic actuator coils, respectively, to backfill a pump cavity and to pump fluid, respectively;

a pressure sensor sensing the pressure of the fluid adjacent an outlet of the fluid pump; and, a controller operative to alternately pulse the first and second actuator coils responsive to an output of the pressure sensor, the controller is configured to provide an electrical pulse to the first electromagnetic actuator coil wherein said pulse has a time width independent of the pressure of the fluid at the outlet of the fluid pump, wherein a fluid flow rate pumped by the fluid pumping system varies with the pulse rate of the controller.

2. The fluid pumping system of claim 1, wherein the controller is configured to provide an electrical pulse to the first actuator coil wherein said pulse has a time width independent of the fluid flow rate pumped by the fluid pumping system.

3. The fluid pumping system of claim 1, wherein the controller is configured to provide an electrical pulse to the second electromagnetic actuator coil wherein said pulse has a time width responsive to the output of the pressure sensor.

4. The fluid pumping system of claim 1, wherein the controller is responsive to the difference in the output of the pressure sensor and a commanded pressure.

5. The fluid pumping system of claim 4, wherein the fluid is an engine fuel.

6. The fluid pumping system of claim 5, wherein the commanded pressure is responsive to engine operating conditions and environmental conditions.

7. The fluid pumping system of claim 1, wherein the fluid pump is submerged in fuel in a fuel supply tank.

8. The fluid pumping system of claim 7, wherein the outlet of the fluid pump is coupled to a fuel rail.

9. The fluid pumping system of claim 8, wherein the fuel rail is coupled to fuel injectors in an engine.

10. The fluid pumping system of claim 1, wherein the fluid pump further comprises:

a pump body having first and second ends;

the piston positioned within the pump body and moveable along an axis of the pump body; and, first and second end caps, each having a passage to allow fluid flow through the respective end cap;

the pump body, the piston and the first and second end caps being formed of magnetically attractable material;

the first end cap being coupled to the first end of the pump body with the first electromagnetic actuator coil encircled between the pump body and the first end cap;

the second end cap being coupled to the second end of the pump body with the second electromagnetic actuator coil encircled between the pump body and the second end cap;

the piston, when in a first position along the axis of the pump body, having a first piston face in contact with a cooperatively disposed face of the first end cap, and when in a second position along the axis of the pump body, having a second piston face in contact with a cooperatively disposed face of the second end cap;

the piston being magnetically attractable to the first position by a magnetic field formed in the first end cap, the piston and the pump body by an electrical current that may be selectively applied in the first electromagnetic actuator coil, the piston biased to remain in the first position by a residual magnetic field existing in the first end cap, the piston and the pump body alter said electrical current in the first electromagnetic actuator coil is terminated;

the piston being magnetically attractable to the second position by another magnetic field formed in the second end cap, the piston and the pump body by another electrical current that may be selectively applied in the second electromagnetic actuator coil, the piston biased to remain in the second position by another residual magnetic field existing in the second end cap, the piston and the pump body after said another electrical current in the second electromagnetic actuator coil is terminated;

the piston having a passage between the first and second piston faces cooperatively disposed with respect to the passages in the first and second end caps, the piston having a first one-way check valve positioned in the passage therein allowing fluid flow only in a first direction towards the second end cap and blocking fluid flow in the opposite direction;

one of the first and second end caps having a second one-way check valve positioned in the respective passage, the second one-way check valve allowing fluid flow only in the same direction as the first one-way check valve and blocking fluid flow in the opposite direction.

11. The fluid pumping system of claim 10, wherein the first and second check valves each include a ball valve.

12. The fluid pumping system of claim 10, wherein the first and second check valves each include an umbrella valve member.

13. The fluid pumping system of claim 10, wherein the first and second check valves each include a ball valve.

14. The fluid pumping system of claim 10, wherein the first and second check valves each include an umbrella valve member.

15. The fluid pumping system of claim 10, further comprising a spring biasing the piston towards the first direction.

16. The fluid pumping system of claim 15, for use in delivering fluid at a predetermined pressure, wherein the spring provides a spring force on the piston so that the magnetic forces caused by actuation electrical currents in the first and second electromagnetic actuator coils and required to move the piston between the first and second positions, respectively, are approximately equal when the fluid pump is delivering fluid at the predetermined pressure.

17. A fluid pumping system comprising:

a dual electromagnetic coil, magnetically latchable fluid pump having a piston operative to move between first and second positions, respectively, in response to actuating current pulses in opposed first and second electromagnetic actuator coils, respectively, to backfill a pump cavity and to pump fluid, respectively;

a pressure sensor sensing the pressure of the fluid adjacent an outlet of the fluid pump; and, a controller operative to alternately pulse the first and second actuator coils responsive to an output of the pressure sensor, the controller being configured to provide an electrical pulse to the first actuator coil wherein said pulse has a time width independent of the fluid flow rate pumped by the fluid pumping system;

wherein a fluid flow rate pumped by the fluid pumping system varies with the pulse rate of the controller.

18. The fluid pumping system of claim 17, wherein the controller is configured to provide an electrical pulse to the first electromagnetic actuator coil wherein said pulse has a time width independent of the pressure of the fluid at the outlet of the fluid pump.

19. The fluid pumping system of claim 18, wherein the controller is configured to provide an electrical pulse to the second electromagnetic actuator coil wherein said pulse has a time width responsive to the output of the pressure sensor.

20. The fluid pumping system of claim 17, wherein the controller is responsive to the difference in the output of the pressure sensor and a commanded pressure.

21. The fluid pumping system of claim 20, wherein the fluid is an engine fuel.

22. The fluid pumping system of claim 21, wherein the commanded pressure is responsive to engine operating conditions and environmental conditions.

23. The fluid pumping system of claim 17, wherein the fluid pump is submerged in fuel in a fuel supply tank.

24. The fluid pumping system of claim 23, wherein the outlet of the fluid pump is coupled to a fuel rail.

25. The fluid pumping system of claim 24, wherein the fuel rail is coupled to fuel injectors in an engine.

26. The fluid pumping system of claim 17, wherein the fluid pump further comprises:

a pump body having first and second ends;

the piston positioned within the pump body and moveable along an axis of the pump body; and, first and second end caps, each having a passage to allow fluid flow through the respective end cap;

the pump body, the piston and the first and second end caps being formed of magnetically attractable material;

the first end cap being coupled to the first end of the pump body with the first electromagnetic actuator coil encircled between the pump body and the first end cap;

the second end cap being coupled to the second end of the pump body with the second electromagnetic actuator coil encircled between the pump body and the second end cap;

the piston, when in a first position along the axis of the pump body, having a first piston face in contact with a cooperatively disposed face of the first end cap, and when in a second position along the axis of the pump body, having a second piston face in contact with a cooperatively disposed face of the second end cap;

the piston being magnetically attractable to the first position by a magnetic field formed in the first end cap, the piston and the pump body by an electrical current that may be selectively applied in the first electromagnetic actuator coil, the piston biased to remain in the first position by a residual magnetic field existing in the first end cap, the piston and the pump body after said electrical current in the first electromagnetic actuator coil is terminated;

the piston being magnetically attractable to the second position by another magnetic field formed in the second end cap, the piston and the pump body by another electrical current that may be selectively applied in the second electromagnetic actuator coil, the piston biased to remain in the second position by another residual magnetic field existing in the second end cap, the piston and the pump body after said another electrical current in the second electromagnetic actuator coil is terminated;

the piston having a passage between the first and second piston faces cooperatively disposed with respect to the passages in the first and second end caps, the piston having a first one-way check valve positioned in the passage therein allowing fluid flow only in a first direction towards the second end cap and blocking fluid flow in the opposite direction;

one of the first and second end caps having a second one-way check valve positioned in the respective passage, the second one-way check valve allowing fluid flow only in the same direction as the first one-way check valve and blocking fluid flow in the opposite direction.

27. The fluid pumping system of claim 26, wherein the first and second check valves each include a ball valve.

28. The fluid pumping system of claim 26, wherein the first and second check valves each include an umbrella valve member.

* * * * *